US005390900A

United States Patent [19]

Ginzburg

[11] Patent Number: 5,390,900

[45] Date of Patent: Feb. 21, 1995

[54] METAL STRIP COOLING SYSTEM

[76] Inventor: Vladimir B. Ginzburg, 612 Driftwood Dr., Pittsburgh, Pa. 15238

[21] Appl. No.: 233,260

[22] Filed: Apr. 26, 1994

[51] Int. Cl.[6] ..... C21D 1/62; B21B 45/02

[52] U.S. Cl. ..... 266/113; 266/114; 266/134; 148/639; 148/644; 148/658; 62/63; 62/64; 62/373; 62/375; 62/376

[58] Field of Search ..... 266/113, 114, 134; 62/63, 64, 373, 375, 376; 148/639, 644, 658

[56] References Cited

U.S. PATENT DOCUMENTS

| | | | |
|---|---|---|---|
| 4,047,985 | 9/1977 | Greenberger | 148/153 |
| 4,076,222 | 2/1978 | Schaming | 266/113 |
| 4,226,108 | 10/1980 | Wilmotte et al. | 72/201 |
| 4,415,381 | 11/1983 | Tani et al. | 148/153 |
| 4,440,584 | 4/1984 | Takeshige et al. | 148/128 |
| 4,497,180 | 2/1985 | Graham | 62/63 |
| 4,591,133 | 5/1986 | Umeno et al. | 266/114 |
| 4,596,615 | 6/1986 | Matsuzaki et al. | 148/128 |

FOREIGN PATENT DOCUMENTS

| | | | |
|---|---|---|---|
| 3316992 | 11/1984 | Germany | 266/113 |
| 57-109516 | 7/1982 | Japan | 266/113 |
| 61-193717 | 8/1986 | Japan . | |

*Primary Examiner*—Melvyn J. Andrews
*Assistant Examiner*—Sikyin Ip

[57] ABSTRACT

An apparatus and method for cooling a metal strip, the apparatus having a header that receives and directs a curtain of water across the strip, a water collector on one side of the curtain of water and a source of air on the opposite side of the curtain of water arranged to direct a flow of air across the curtain of water and divert water into the water collector. A deflector is arranged to interrupt at least a portion of the flow of air such that at least a portion of the wall of water contacts and cools the strip of metal. The flow of air is provided at a pressure of about 50 to 100 psi and, with the flow of air completely blocked by a deflector, the strip of metal is cooled completely across the width of the strip.

10 Claims, 4 Drawing Sheets

METAL STRIP COOLING SYSTEM

FIELD OF THE INVENTION

The present invention relates to a cooling system used to cool a hot metal strip passing by the cooling apparatus.

BACKGROUND OF THE INVENTION

A majority of flat-rolled steel products are produced at least in part in continuous hot strip mills wherein steel slabs are hot rolled to hot-rolled sheet and strip products, either in finished form, or semi-finished form for further processing.

Whether the hot rolled steel is a finished product or semi-finished for further processing (e.g., cold rolling to cold rolled products), the hot rolled steel should be cooled uniformly at a controlled rate for the purpose of achieving a predetermined microstructure and accordingly certain physical properties in the hot rolled product before the steel reaches the coiling stand. Specifically, the cooling rate must not be so fast as to quench the steel to a brittle condition, but must be fast enough to achieve transformation to a predetermined ferrite microstructure depending upon the properties desired. Also, the cooling rate should be sufficiently uniform such that the entire steel coil has reasonably uniform physical properties at all locations along its length and across its width.

Typically, a number of water spray nozzles are horizontally positioned for the purpose of spraying water onto the workpiece as it moves along a runout table towards a coiling stand. Prior art cooling systems have traditionally comprised a plurality of horizontally positioned, side-by-side water pipes which extended transversely above the path of travel of the workpiece, with each water pipe provided with a number of spray nozzles to spray the workpiece as it moves along the runout table. Considerable improvements have been made in the apparatus in recent years. Specifically, more modern cooling systems typically provide headers or water boxes positioned transversely above the runout table, each provided with nozzles to direct a low-pressure stream of water onto the moving workpiece. The headers are normally provided with a plurality of siphon tubes or elongated "stand-pipe" type nozzles which direct a low-pressure laminated flow of cooling water downwardly onto the workpiece from above. Such low-pressure laminar flows of cooling water have been found to provide an increased and more uniform cooling rate than the prior spray nozzles which virtually spray the water onto the hot steel, and minimize splashing to achieve a more uniform cooling of the workpiece.

It is also important that the cooling system utilized be suited for cooling moving workpieces of differing thicknesses and widths and workpieces moving at differing line speeds, and even suitable to provide uniform cooling rates even if the workpiece strip speed is accelerated or decelerated while moving on the runout table. All of these requirements necessitate rather complicated cooling systems, which, pursuant to current practices, are provided with valve means for selectively turning-on or turning-off the water to the various headers or header portions thereby switching certain headers or portions thereof into or out of operation in response to need for varying the overall cooling rates or varying the width of the water spray to accommodate workpieces of differing widths. When such changes are made, the response time should be rather quick and certain without any delays, and without any non-uniform commencement or cessation of the water spray distribution. The syphon tubes and stand-pipe tubes now commonly utilized for nozzles are designed to draw water from the upper surface of the header, and do, therefore, provide the advantage that shut-off and turn-on of the water supply to the header will normally provide a very quick response in the stoppage or commencement of water flow through the elongated nozzles.

When water is applied to a metal strip at an even cooling flow rate across the width of the hot strip, there is a flow of water from the center towards the edges of the strip which causes cooling of the edge faster than the middle portion of the strip. Solving of this problem, at present, is attempted by either shaping of a slot through which the cooling water is discharged onto the strip, by redistributing water across the strip width, or by partial deflection of water by the use of solid deflectors. Such systems are, however, of complicated design and in the form of cumbersome equipment, which do not provide a smooth transition between chilled and non-chilled areas of the strip.

It is an object of the present invention to provide a cooling system for cooling of a hot metal strip which uses uncomplex and lightweight equipment to control the flow of cooling water across the width, or portion of the width, of hot metal strips of various widths and which provides for a quick and smooth adjustment of rates of cooling across the metal strip.

SUMMARY OF THE INVENTION

An apparatus for cooling a metal strip passing by the apparatus has a header for receiving water and directing a curtain of water onto and across the metal strip, a water collector on one side of the water curtain, an air source on the opposite side of the water curtain arranged to direct an air flow across the water curtain so as to divert the water curtain and direct the water into the water collector, and a deflector that is arranged to interrupt at least a portion of the air flow so that at least a portion of the water curtain is undiverted and contacts and cools the metal strip.

The water header is preferably in the form of a housing that includes an opening in the bottom wall and a weir over which water flows and is discharged through the opening, while the water collector is preferably a conduit having a slot in the sidewall facing the water curtain, with the diverted water directed through the slot and into the conduit. The air source may be a manifold into which pressurized air is fed, the manifold having a plurality of spaced nozzles arranged to direct a flow of air across the curtain of water. The deflector is a metal plate that is movable, preferably slidably movable, across the flow of air to block at least a portion of the air flow, and preferably has a downwardly depending central section.

According to the method of the present invention, a curtain of water is directed towards, and across the width of, a surface of a moving metal workpiece, and a flow of air is directed so as to interrupt the flow of water prior to contact with the workpiece and divert the water into a water collector. At least a portion of the flow of air is blocked at predetermined locations such that at least a portion of the flow of water, that which is undiverted, contacts and cools the moving metal workpiece. When the flow of air is completely blocked, the water cools the moving metal workpiece across the width thereof.

BRIEF DESCRIPTION OF THE DRAWINGS

The present invention will be more fully understood by reference to the following drawings of a preferred embodiment of the apparatus, wherein.

DETAILED DESCRIPTION

The present apparatus and method provide for the cooling of a moving metal workpiece, such as a hot metal strip, across the complete width of the workpiece by application of cooling water or across only predetermined portions of the width, such as the central portion while not applying water to the side edge portion of the metal workpiece.

Figure 1:
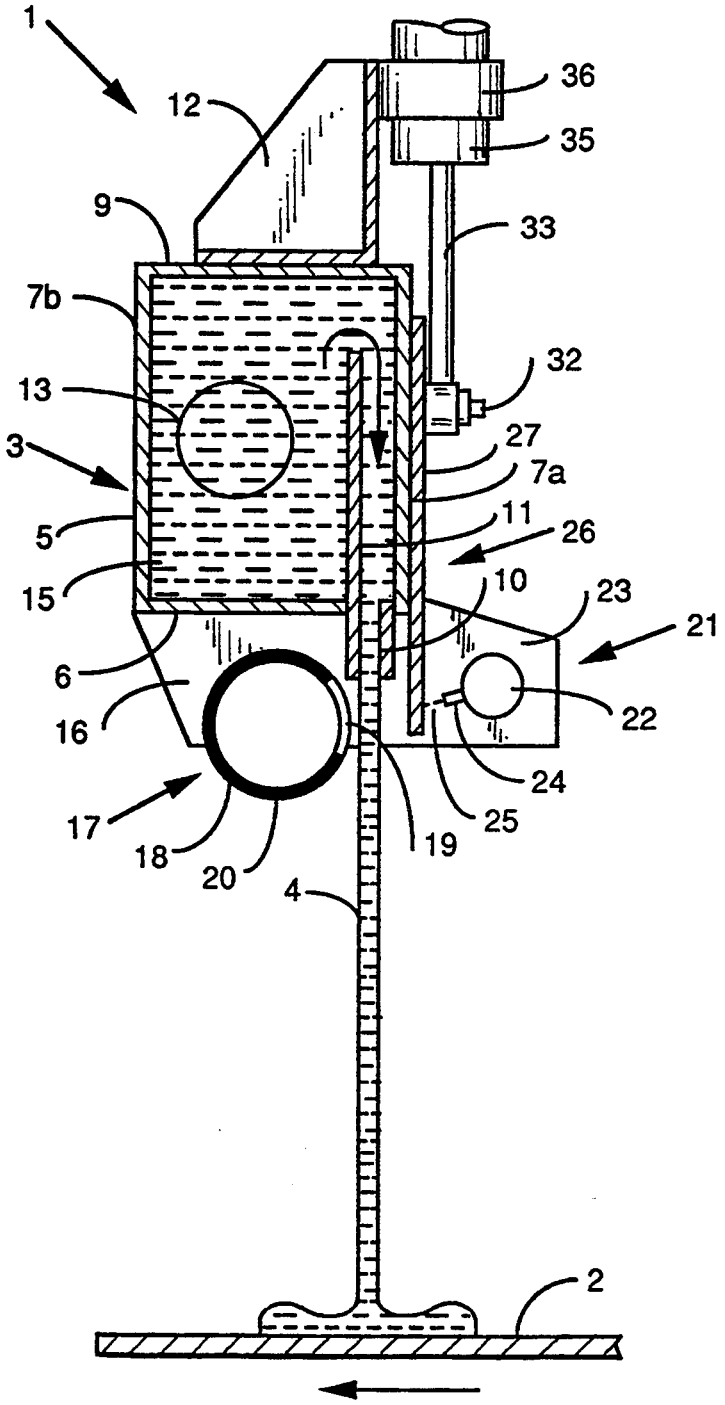
FIG. 1 is a side elevational cross-sectional view of the strip cooling apparatus showing cooling of a metal strip across the width of the strip.
Figure 2:
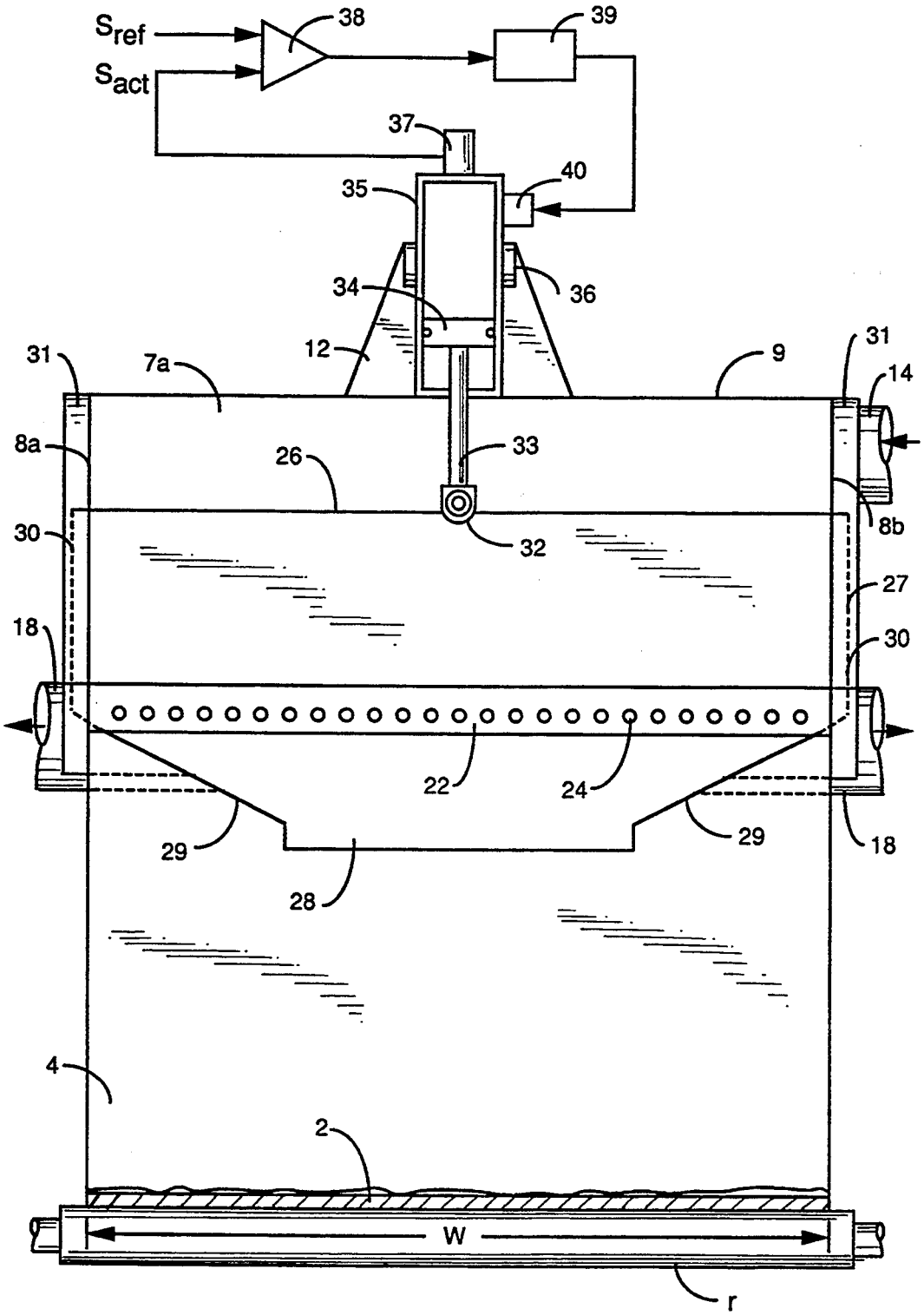
FIG. 2 is a front elevational view of the apparatus of FIG. 1 as viewed from the right side of that figure.
Figure 3:
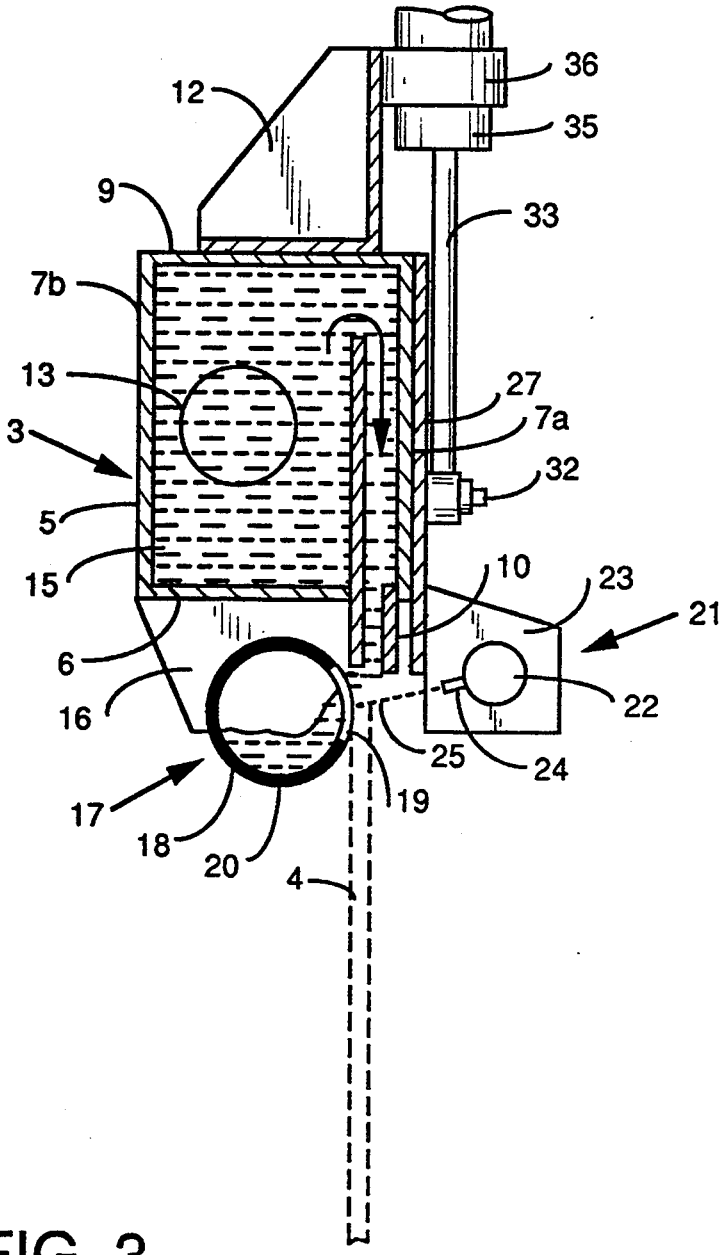
FIG. 3 is a side elevational view similar to FIG. 1 wherein a portion of the curtain of water is diverted so as to cool a metal strip of a narrower width.
Figure 4:
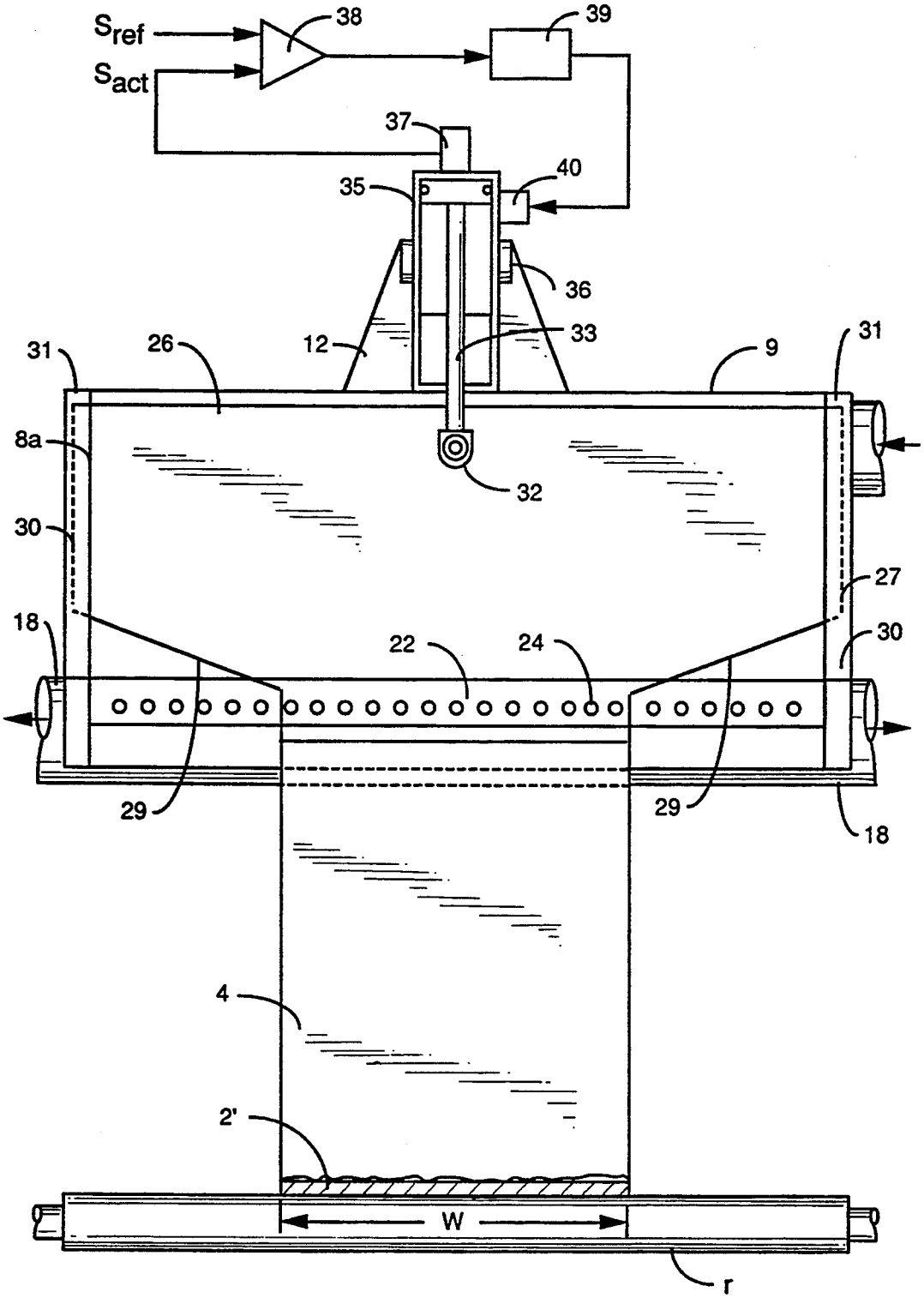
FIG. 4 is a front elevational view corresponding to FIG. 3 as viewed from the right side of that figure.

Referring now to the drawings, FIGS. 1 and 2 illustrate the apparatus 1 of the present invention where water is applied completely across the width w of a metal workpiece such as a metal strip 2 passing below the apparatus 1, the metal workpiece 2 moving in the direction of the arrow in FIG. 1, while FIGS. 3 and 4 illustrate the present invention where water is applied across the width of a narrower strip of metal. The cooling apparatus 1 comprises a means 3 for directing a curtain of water 4 onto and across the width w of the metal strip 2, being moved by roll r, and is illustrated as a water header having a housing 5 with a bottom wall 6, side walls 7*a* and 7*b*, end walls 8*a* and 8*b* and a top wall 9. An open channel 10 is provided across the bottom wall 6, adjacent a side wall 7*a*, and a weir 11 is attached to the bottom wall 6 on the side of the open channel 10 spaced from the side wall 7*a*. A support beam 12 attached to a support frame (not shown) positions the means 3 for directing the curtain of water 4 across and onto the metal strip 2. An inlet 13 is in fluid communication with feed pipe 14 into which water is fed from a source (not shown), with the water flowing through pipe 14 and inlet 13 into a chamber 15 formed by housing 5, with the water flowing over weir 11 into a gap between weir 11 and side wall 7*a* and outwardly through the open channel 10 to form the curtain of water 4. Attached to the housing 5, preferably by a bracket 16 is a water collector 17, on one side of and spaced from the curtain of water 4, illustrated as a conduit 18 having a collection slot 19 in the wall 20 of conduit 18, the collection slot 19 facing the curtain of water 4 flowing from the housing 5. The conduit 18 may be open at both ends so as to discharge water collected therein into a holder (not shown) for reuse or discharge from the apparatus 1.

An air source 21 is situated on the other side of the curtain of water 4 than that on which the water collector 17 is situated. The air source 21 is illustrated as an air pipe 22, supported by end brackets 23, into which a supply of pressurized air is charged from a source of pressurized air (not shown), and a plurality of spaced nozzles 24, which extend across the width w of the strip of metal 2. The air source 21 is arranged to direct a flow of air 25 across the curtain of water 4 so as to divert the water into the water collector 17 when the flow of air is unblocked.

A deflector 26, illustrated as a slidable plate 27, is positioned between the air pipe 22 with nozzles 24 and the curtain of water 4, which deflector 26 is slidably movable from a position away from the flow of air 25 to a position which interrupts at least a portion of the flow of air 25. The slidable plate preferably has a downwardly depending central section 28 and upwardly angled sections 29 on either side of the downwardly depending central section which meet with the side edges 30 of the slidable plate 27. The slidable plate is slidable in guide members 31 on either side thereof and is movable by action of an attached support 32 attached to the end of a hydraulically activated piston rod 33. Piston rod 33 is attached to a piston 34 movable in cylinder 35, which cylinder 35 is attached to support beam 12 by means of a cylinder bracket 36.

Blocking of the flow of air 25, as desired, is provided by moving deflector 26 through use of piston rod 33 by means of hydraulic cylinder 35. The cylinder position reference $S_{ref}$ is generated either based on computer modeling of the cooling process or is based on actual measurement of strip profile temperature across the strip width w of the strip of metal 2. This reference signal $S_{ref}$ is compared with an actual cylinder position signal $S_{act}$ generated by a cylinder position transducer 37 and the effected signal is input into position regulator 38 and further processed by a servovalve controller 39 to control flow of fluid into and out of the cylinder 35 through servovalve 40.

In the aforementioned apparatus, various different embodiments may be provided with alternate equipment. For example, a stepped motor may be used in place of the hydraulic cylinder to slidably move the deflector place. Or, laminar flow tubes may be used to form the curtain of water rather than the housing described which forms a flow of water or waterwall.

According to the present method, a moving metal workpiece, such as a moving hot metal strip may be cooled completely across the width of the strip or across only a portion of the width. A curtain of water is directed towards the surface of a hot moving metal strip across the width of the strip and a flow of air is directed, substantially parallel to the direction of movement of the strip of metal and transverse the curtain of water, so as to interrupt the curtain of water and direct water into a water collector for removal. The flow of air is provided from a source of pressurized air and is preferably directed across the curtain of water at a pressure of between about 50 to 100 pounds per square inch gauge pressure. At least a portion of the flow of air is blocked such that at least a portion of the curtain of water is undiverted and contacts and cools the moving strip of metal.

In FIGS. 1 and 2, for example, the flow of air is blocked across the width w of the strip of metal such that no water is diverted and a flow of water is provided and contacts the strip of metal across the width of the strip of metal. In FIGS. 3 and 4, a strip of metal 2' of a narrower width w', relative to the width w of the strip of metal in FIGS. 1 and 2, is cooled with the air nozzles 24 in the center portion of conduit 17 blocked by slidable plate 27, while the air nozzles at the side regions of the conduit 17 remain unblocked so that the curtain of water at the side regions is diverted into the water collector while the central portion of the curtain of water contacts and cools the metal strip 2'. In addition to blocking of the flow of air discharged from the central region of the conduit to cool a narrower strip of metal 2', such selective blocking may also be used where only a predetermined portion of a wider strip of metal is to be cooled, thus cooling the strip of metal over only a portion of width of the strip.

What is claimed is:

1. An apparatus for cooling a metal workpiece passing by said apparatus comprising:

means for directing a curtain of water onto and across the width of said metal workpiece;

a water collector on one side of said curtain of water;

an air source on the other side of said curtain of water arranged to direct a flow of air across said curtain of water so as to divert the same and direct said water into said water collector; and a deflector disposed directly opposite said water collector and between said water collector and said air source, arranged to interrupt at least a portion of said flow of air so that at least a portion of said flow of air is blocked across the width of said moving metal workpiece, while at least a portion of said curtain of water is undiverted and contacts and thus cools the metal workpiece.

2. The apparatus for cooling a metal workpiece as defined in claim 1 where said means for directing a curtain of water onto and across the width of said metal workpiece comprises a water header having a housing with an inlet for water and a weir over which water flows to form said curtain of water.

3. The apparatus for cooling a metal workpiece as defined in claim 2 wherein said water collector comprises a conduit having a slot in the sidewall thereof facing said curtain of water into which said diverted water is directed.

4. The apparatus for cooling a metal workpiece as defined in claim 3 wherein said air source comprises a manifold into which pressurized air is fed and a plurality of spaced nozzles arranged to direct said flow of air across said curtain of water.

5. The apparatus for cooling a metal workpiece as defined in claim 1 wherein said deflector comprises a metal plate movable across said flow of air, between said air source and said curtain of water, to block at least a portion of said flow of air prior to diverting thereby of said curtain of water.

6. The apparatus for cooling a metal workpiece as defined in claim 5 wherein said metal plate is slidably movable and has a downwardly depending central section.

7. An apparatus for cooling a metal workpiece passing by said apparatus comprising:

means for directing a curtain of water onto and across the width of said metal workpiece;

a water collector on one side of said curtain of water;

an air source on the other side of said curtain of water arranged to direct a flow of air across said curtain of water so as to divert the same and direct said water into said water collector; and a deflector, disposed directly opposite said water collector and between said water collector and said air source, comprising a metal plate, having a downwardly depending central section, slidably movable across said flow of air, between said air source and said curtain of water, arranged to interrupt at a portion of said flow of air so that at least a portion of said flow of air is blocked across the width of said moving metal workpiece, while at least a portion of said curtain of water is undiverted and contacts and thus cools the metal workpiece.

8. The apparatus for cooling a metal workpiece as defined in claim 7 where said means for directing a curtain of water onto and across the width of said metal workpiece comprises a water header having a housing with an inlet for water and a weir over which water flows to form said curtain of water.

9. The apparatus for cooling a metal workpiece as defined in claim 7 wherein said water collector comprises a conduit having a slot in the sidewall thereof facing said curtain of water into which said diverted water is directed.

10. The apparatus for cooling a metal workpiece as defined in claim 7 wherein said air source comprises a manifold into which pressurized air is fed and a plurality of spaced nozzles arranged to direct said flow of air across said curtain of water.

* * * * *

UNITED STATES PATENT AND TRADEMARK OFFICE

CERTIFICATE OF CORRECTION

PATENT NO. : 5,390,900

DATED : February 21, 1995

INVENTOR(S) : Vladimir B. Ginzburg

It is certified that error appears in the above-indentified patent and that said Letters Patent is hereby corrected as shown below:

On the title page:

Assignees: International Rolling Mill Consultants, Inc.; United Engineering, Inc., Pittsburgh, Pa.

Attorney, Agent, or Firm: Armstrong, Westerman, Hattori, McLeland and Naughton

Signed and Sealed this

Twenty-fifth Day of April, 1995

*Attest:*

Bruce Lehman

BRUCE LEHMAN

*Attesting Officer*

*Commissioner of Patents and Trademarks*